United States Patent [19]

Borea et al.

[11] Patent Number: 4,592,109

[45] Date of Patent: Jun. 3, 1986

[54] TOOTHBRUSH WITH A DEVICE FOR THE PERFECT ORIENTATION OF THE BRISTLES WITH RESPECT TO THE SURFACE OF THE TEETH

[75] Inventors: Giorgio Borea, 27 Via S. Vitale, Bologna, Italy, 40125; Nerio Pantaleoni, Bologna, Italy

[73] Assignee: Giorgio Borea, Bologna, Italy

[21] Appl. No.: 663,970

[22] Filed: Oct. 23, 1984

[51] Int. Cl.[4] ..... A46B 9/04

[52] U.S. Cl. ..... 15/172; 15/144 R; 15/145; 15/176; 40/314; D4/104

[58] Field of Search ..... 15/172, 176, 167 R, 15/167 A, 144 R, 145; 40/314, 19; 433/146; 403/27, 361; D4/104–117

[56] References Cited

U.S. PATENT DOCUMENTS

| | | | |
|---|---|---|---|
| 490,831 | 1/1893 | Löhers | 15/172 |
| 2,847,219 | 8/1958 | Shoemaker et al. | 403/27 X |
| 2,921,326 | 1/1960 | Lautmann | 403/361 |
| 3,430,345 | 3/1969 | Abreu | 433/144 |
| 3,485,520 | 12/1969 | Alexander | 15/145 X |

FOREIGN PATENT DOCUMENTS

| | | | |
|---|---|---|---|
| 1903020 | 8/1970 | Fed. Rep. of Germany | 15/172 |
| 2840429 | 3/1980 | Fed. Rep. of Germany | 15/167 R |

*Primary Examiner*—Peter Feldman
*Attorney, Agent, or Firm*—Browdy and Neimark

[57] ABSTRACT

Toothbrush with a device for the perfect orientation of the bristles with respect to the surface of the teeth, comprising an anatomical grip with adjustable orientation fixing means on one end for a rod having a head of bristles on the end.

7 Claims, 3 Drawing Figures

TOOTHBRUSH WITH A DEVICE FOR THE PERFECT ORIENTATION OF THE BRISTLES WITH RESPECT TO THE SURFACE OF THE TEETH

BACKGROUND OF THE INVENTION

The present invention relates to a toothbrush with a device for the perfect orientation of the bristles with respect to the surface of the teeth.

It is known that perfect dental hygiene requires that the bristles of the toothbrush be inclined differently as a function of the arrangement in the oral cavity of the teeth being cleaned and of the orthogonal or longitudinal movement of the toothbrush with respect to the teeth.

In practice, in cleaning the inner or outer surfaces of the front or side teeth of the upper or lower arch, horizontal or vertical brushing movements may be made, for each of which there is a specific optimal orientation of the bristles with respect to the teeth. However, it has been shown that the users either do not take this requirement into account, or do so in an empirical and approximate manner, and that known toothbrushes, if said requirement is taken into account, must be held in an inappropriate and uncomfortable manner or that the wrist must be rotated in an anomalous way. Furthermore, with known toothbrushes even when the user is made aware of the problem, it is very difficult to communicate clear notions of how to use and hold the toothbrush in order to clean the teeth perfectly.

OBJECTS AND SUMMARY OF THE INVENTION

The technical aim of the present invention is to overcome the problems cited above, that is, to provide a toothbrush which may be held comfortably and with which the bristles may be oriented in the most advantageous way to the surface of the teeth.

Within this technical aim, the invention aims to realize a toothbrush with which simple and clear instructions may be communicated to the user on how to proceed for an excellent cleaning.

Another aim of the present invention is to satisfy the above aims with a simple structure, of relatively easy practical production, safe to use, and effective and intuitive in function, as well as relatively low in cost.

These aims are achieved with the present toothbrush with a device for perfect orientation of the bristles with respect to the surface of the teeth, characterized by the fact that it comprises an anatomical grip with adjustable orientation fixing means on one end for a short rod having a head of bristles on the end.

BRIEF DESCRIPTION OF THE DRAWING

Further details are shown more clearly in the detailed description of a preferred, but not exclusive, embodiment of a toothbrush according to the invention shown in an indicative but non-limiting fashion in the attached drawing, in which.

DETAILED DESCRIPTION OF THE INVENTION

Figure 1:
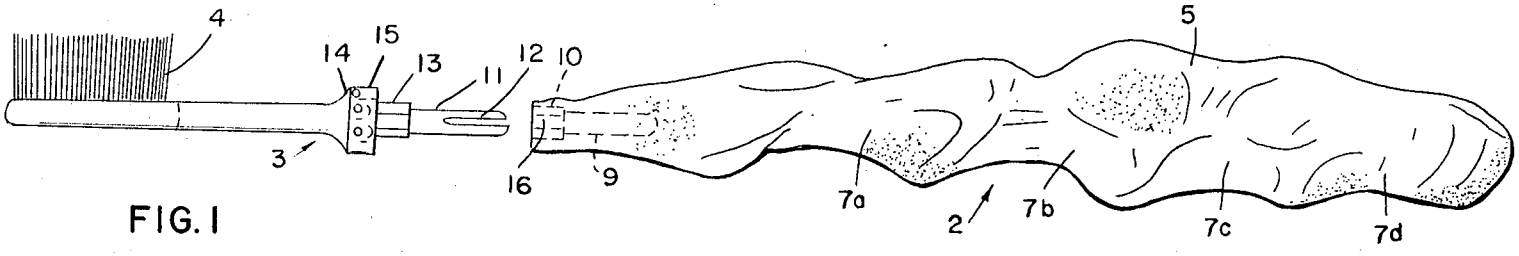
FIG. 1 is a lateral, exploded view of a toothbrush according to the invention.
Figure 2:
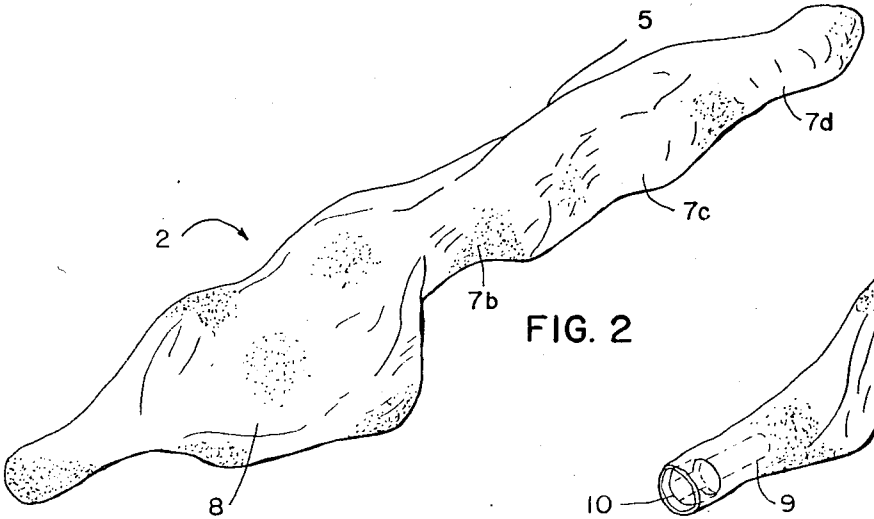
FIG. 2 is a perspective view of the grip of the toothbrush.
Figure 3:
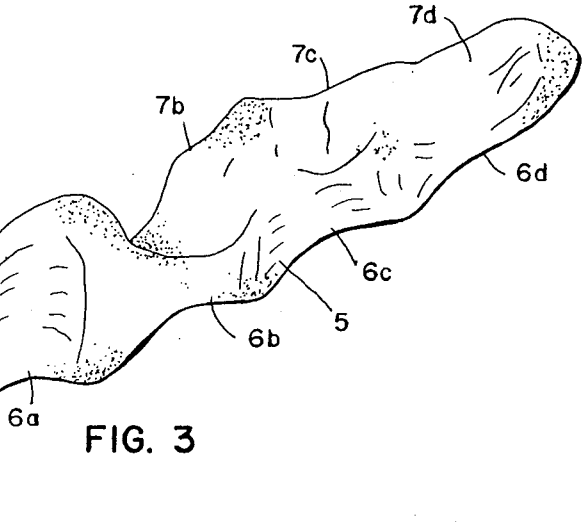
FIG. 3 is a perspective view of the grip in FIG. 2 from another point of view.

With reference to FIG. 1, the whole toothbrush according to the invention is designated with the numeral 1. The toothbrush 1 comprises a grip 2 and a rod 3 with a head 4 of bristles on the end. The rod may be attached to the grip by adjustable orientation fixing means. The entire assembly is designed to be molded from a material such as plastic.

The grip 2 has an anatomical shape 5, showing grooves *6a, 6b, 6c, 6d* for placing the middle joints, depressions *7a, 7b, 7c, 7d* for the top joints of the long fingers (from the index finger to the little finger), and a broad flattened area 8 slightly concave in the center for placing the tip of the thumb. For left-hand users, this anatomical shape may also be used, however for the left hand the best arrangement of the fingers has the index, middle and ring fingers in the grooves and depressions indicated as *6b, 7b, 6c, 7c, 6d, 7d,* respectively.

At the end of the grip there is an axial hole with a substantially cylindrical section portion 9 and a right regular prism-shaped portion 10 with hexagonal bases (advantageously portion 9 is slightly conical, converging toward the bottom). The rod extends axially with a stem 11 having a terminal portion with cylindrical section, which can be forced into portion 9 of said hole and which preferably has a longitudinal diametral cut 12 giving a certain elasticity to the coupling with portion 9 of the hole in the grip. Said stem 11 has a hexagonal base prism-shaped portion 13 which can engage the portion 10 of the hole in the grip.

Rod 3 also has a widened portion 14 which has on the outside a surface blending into that of the rod, and which has an annular goniometric scale 15 divided in parts of 60°. The grip has a reference notch 16 for the indications of the goniometric scale 15.

In practice, changing the orientation of the rod with respect to the grip simply involves pulling out stem 11 until the portion 13 comes out of portion 10, then rotating the rod to the desired angle, read from scale 15, and then putting the hole all the way. The relative rotation of grip and rod is prevented by the reciprocal prismatic coupling, while axial decoupling is prevented by the forcing of the stem in the hole, by the elasticity of the stem due to cut 12 and by the slight conicity of the portion 9 of the hole.

The rod may be thinned down in the portion between the head 4 of bristles and the widened portion 14.

Since the position and orientation of the user's hand is rigorously fixed by the anatomical shape of the grip, it is certain that all users hold the toothbrush in the same way and that therefore the reference notch 16 will for all users be rigorously oriented the same way with respect to the wrist (with the hand in a position of natural alignment with the forearm).

By virtue of this constrained grip configuration, it is easy to give the user suitable instructions for rotating the rod 3 with respect to the grip 2 in the best way for the bristles to be oriented correctly with respect to the surfaces of the teeth to be cleaned.

Therefore, the invention achieves the stated aims.

The invention so conceived may be modified in numerous ways, without going beyond the scope of the inventive concept.

All the details may be replaced by others technically equivalent.

For instance, the materials used, as well as the shapes and dimensions, may be any as required, without going outside the scope of the present invention.

We claim:

1. A toothbrush including apparatus for the perfect orientation of the bristles with respect to the surface of the teeth, comprising: an anatomical grip having, at one end, an axial hole with a first portion including a substantially cylindrical section and a second, right regular prism-shaped portion; and a rod-like stem having at one end a head of bristles, and a terminal portion of cylindrical section at the opposite end, the terminal portion being forcibly insertable into said cylindrical portion of the axial hole of the grip, said stem being provided with a prism-shaped portion cooperating with said prism-shaped portion of the hole of the grip.

2. The toothbrush according to claim 1, wherein said prism-shaped portions have hexagonal bases.

3. The toothbrush according to claim 1, wherein said stem has an annular goniometric scale, while said grip has a reference notch for reading the orientation of the head of bristles with respect to the grip.

4. The toothbrush according to claim 1, wherein said terminal portion of the stem has a longitudinal cut to allow slight elastic deformation thereof.

5. In a toothbrush having a bristle-bearing head portion including bristles having ends defining a surface for engaging teeth to be brushed, and a radially non-symmetrical, anatomically-shaped handle portion having a longitudinal extent, the head portion being securable at a securing end thereof to the front end of the handle portion in a first reference position, the improvement comprising:

annular means, carried by said front end of said handle portion and said securing end of said head portion, for securely positioning and holding said teeth engaging surface in a selected one of several other discrete positions circumferentially displaced from said first reference position about said handle portion longtudinal extent; and means carried by each of said head portion and said handle portion, for indicating the circumferential displacement of said selected discrete position relative to said first reference position.

6. The improvement of claim 5, wherein said annular positioning and holding means of said handle portion and said head portion are configured to permit reorientation of said teeth engaging portion relative to said reference position in at least three positions circumferentially displaced from said reference position by multiples of approximately 30°.

7. The improvement of claim 6, wherein said annular positioning and holding means of said handle portion comprises a bore having a portion of hexagonal cross-section, and said annular positioning and holding means of said head portion comprises a rod having a portion of similar cross-section.

* * * * *